United States Patent [19]

Ille

[11] 4,193,263

[45] Mar. 18, 1980

[54] FLUID CONTROL SYSTEM WITH INDIVIDUALLY VARIABLE FLOW CONTROL MECHANISM FOR EACH CONTROL SECTION

[75] Inventor: David R. Ille, Wooster, Ohio

[73] Assignee: Borg-Warner Corporation, Chicago, Ill.

[21] Appl. No.: 928,649

[22] Filed: Jul. 27, 1978

[51] Int. Cl.[2] ..... F15B 11/16; F15B 15/18

[52] U.S. Cl. ..... 60/420; 60/445; 60/459; 60/484; 91/525

[58] Field of Search ..... 60/420, 426, 427, 445, 60/452, 459, 468, 484, 494; 91/508, 511, 525

[56] References Cited

U.S. PATENT DOCUMENTS

| | | | |
|---|---|---|---|
| 2,102,865 | 12/1937 | Vickers | 60/468 X |
| 3,592,216 | 7/1971 | McMillen | 91/433 X |
| 3,631,890 | 1/1972 | McMillen | 137/596.13 |
| 3,693,506 | 9/1972 | McMillen et al. | 91/433 |
| 3,982,469 | 9/1976 | Bianchetta | 60/484 X |
| 4,087,968 | 5/1978 | Bianchetta | 60/445 |

*Primary Examiner*—Edgar W. Geoghegan
*Attorney, Agent, or Firm*—Julian Schachner

[57] ABSTRACT

A fluid control system includes a directional control valve assembly adapted for use in either an open-center or a closed-center configuration. The system is capable of incorporating one or more control sections, each with a manual control valve and its own individually variable flow control mechanism. Each flow control mechanism is independently responsive to section load pressure, and is capable of controlling the flow rate delivered to its section when the control valve spool is biased to a full power position. Each section contains a kickout mechanism for returning the control valve spool to its neutral position at a predetermined pressure.

21 Claims, 10 Drawing Figures

FLUID CONTROL SYSTEM WITH INDIVIDUALLY VARIABLE FLOW CONTROL MECHANISM FOR EACH CONTROL SECTION

BACKGROUND OF THE INVENTION

In recent years there has been significant progress in the development of pressure-compensated directional control valve assemblies for fluid control systems. U.S. Pat. No. 3,693,506 discloses a control circuit for a plurality of manual control valves, each controlling a fluid motor. The control circuit includes a logic system for sensing each load-actuating pressure, and for selecting the highest pressure sensed and directing this pressure to actuate means for controlling a source of supply pressure. U.S. Pat. No. 3,592,216 discloses a flow control valve for use with such a control circuit. The flow control valve limits the pressure supplied to the manual control valves and maintains the required fluid flow thereto. U.S. Pat. No. 3,631,890 discloses a flow-extending bypass valve which may be used with the control circuit. The flow-extending bypass valve adjusts automatically to bypass fluid at an increased differential pressure when a fluid motor is actuated, thereby extending the flow capacity of the manual control valve associated with the fluid motor. U.S. Pat. No. 4,145,958 discloses that such a pressure-compensated directional control valve assembly may incorporate a manual control valve having a float position as well as neutral and power positions.

There remains a need in the art for a fluid control system wherein each control section includes its own individually variable flow control mechanism independently responsive to section load pressure and capable of controlling the flow rate delivered to that section while the manual control valve spool is in a full power position. When a directional control valve assembly incorporates a plurality of flow control sections, or when a plurality of assemblies are incorporated in the fluid control system, each flow control mechanism should be individually variable and independently responsive to the load pressure of its section.

SUMMARY OF THE INVENTION

This invention is directed in brief to a fluid control system capable of meeting the need noted above. The system includes a fluid supply section, an inlet section and a directional control valve assembly having at least one control section, with each control section including a manual control valve. Each manual control valve is adapted for connection to a fluid motor. The fluid control system also includes a logic system for sensing each load-actuating pressure, and for directing the highest pressure sensed to actuate means for controlling supply pressure.

Each control section includes an individually variable pressure-compensated flow control mechanism. The mechanism is responsive independently to section load pressure, and is capable of controlling the flow rate delivered to the section. This is accomplished by actuation of a variable orifice while the control valve spool is in full power or detented position. Of course, it also may be accomplished by the conventional method of moving the control valve spool so as to vary the meter land opening within its valve bore. Each section also includes a pressure responsive kickout for returning the valve spool from its detented position to its neutral position at a predetermined pressure level.

The invention contemplates that the fluid control system may include a plurality of directional control valve assemblies. In this arrangement there are a fluid supply section, an inlet section and a plurality of directional control valve assemblies, each assembly having one or more control sections, and each control section including a flow control mechanism.

BRIEF DESCRIPTION OF THE DRAWINGS

The objects and advantages of this invention will become apparent to those skilled in the art upon careful consideration of the specification herein, including the drawings, wherein.

Figure 1:
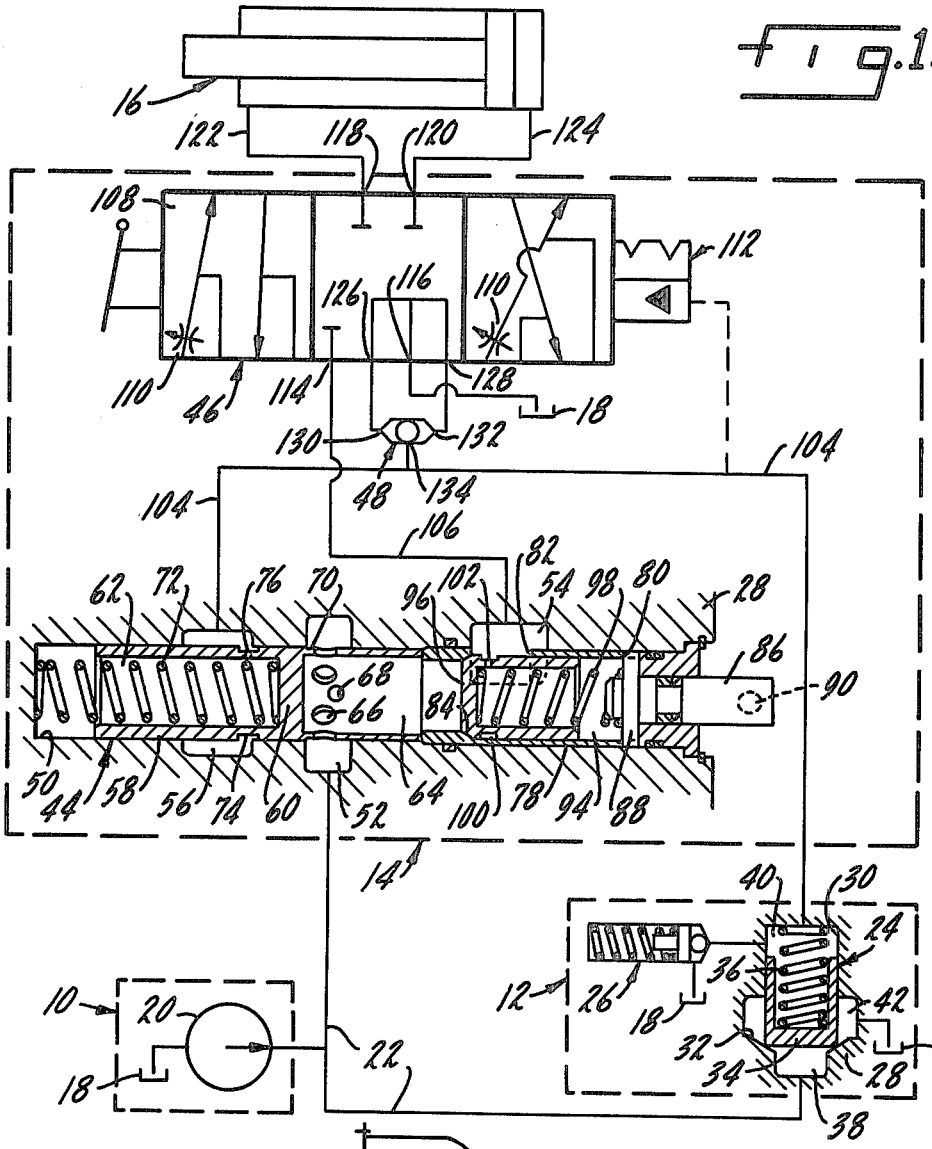
FIG. 1 is a schematic diagram showing the fluid control system including a directional control valve assembly having a single control section. The assembly is of the type having an open-center valve and a fixed displacement pump.

While this invention is susceptible of embodiment in many different forms, there is shown in the drawings and herein will be described in detail a preferred embodiment. It should be understood that the present disclosure is considered to be an exemplification of the principles of the invention, and is not intended to limit the invention to this embodiment.

DESCRIPTION OF A PREFERRED EMBODIMENT

Referring now to the drawings in greater detail, and in particular to FIG. 1, there is shown an open-center fluid control system including a fluid supply section 10, an inlet section 12, a directional control valve assembly 14 and a fluid motor 16.

Fluid supply section 10 is similar in construction and operation to the fluid supply section disclosed in the aforementioned U.S. Pat. No. 3,693,506. Fluid supply section 10 includes a reservoir or tank 18 and a pump 20. In the form of the invention shown in FIG. 1, pump 20 is a fixed displacement pump. The output of pump 20 is connected to a fluid line 22.

Inlet section 12 is similar in construction and operation to the inlet section disclosed in the aforementioned U.S. Pat. No. 3,693,506. Inlet section 12 includes a bypass valve 24 and a relief valve 26. Bypass valve 24 includes, in a housing 28, a bore 30 and a bypass valve seat 32. A bypass valve element 34 is slidable in bore 30 and is biased by a bypass valve spring 36 toward engagement with valve seat 32. At the head end of valve element 34 a bypass inlet chamber 38 is in fluid communication with fluid line 22. At the spring end of bypass element 34 a bypass spring chamber 40 is in fluid communication with relief valve 26, which in turn communicates with tank 18. Between chambers 38 and 40 a bypass outlet chamber 42 also is in communication with tank 18. When spring chamber 40 is in fluid communication with tank 18, the force of spring 36 will determine supply pressure. For example, if spring 36 is selected to have a force equivalent to 100 psi, it will tend to bias valve element 34 toward valve seat 32, thereby tending to restrict fluid communication between chambers 38 and 42. Supply bypass pressure, the output from pump 20, will be 100 psi.

When fluid communication from chamber 40 to tank 18 is closed off and fluid pressure is directed into spring chamber 40, the pressure developed by pump 20 will increase. For example, if 100 psi is introduced into chamber 40, this pressure, in addition to the force of spring 36, will tend to bias element 34 closer to seat 32, thereby further restricting fluid communication from chamber 38 to chamber 42. As a result, supply pressure will be increased to 200 psi when pump flow is bypassed. Relief valve 26 determines the maximum level of fluid pressure allowable in spring chamber 40, above which relief valve 26 opens and vents chamber 40 to tank 18.

If it is desired to incorporate a flow-extending bypass valve in the system, the bypass valve disclosed in the aformentioned U.S. Pat. No. 3,631,890 may be substituted for inlet section 12 herein.

Directional control valve assembly 14 has a single control valve section, and includes a flow control mechanism or valve 44, a manual control valve 46 and a logic circuit incorporating as a portion thereof a primary shuttle valve 48. Primary shuttle valve 48 corresponds to shuttle valve 31 in the aforementioned U.S. Pat. No. 3,693,506.

Flow control valve 44 includes a stepped bore 50 defined by housing 28, a flow control inlet chamber 52 in fluid communication with fluid line 22, a flow control outlet chamber 54, and a flow control pressure chamber 56. As most clearly shown in FIG. 8, outlet chamber 54 extends only partially around bore 50 for a purpose to be disclosed.

A flow control element or spool 58 is slidable in bore 50 and is generally of an annular configuration having a barrier portion 60 which separates chambers 62 and 64. Suitable orifices 66 are aligned radially and extend through spool 58 so as to communicate chamber 52 with chamber 64. When spool 58 is in the position shown in FIGS. 1 and 4, an additional orifice 68, slightly smaller than orifices 66 and offset therefrom opposite barrier portion 60, also extends through spool 58 so as to communicate chamber 52 with chamber 64. An annular groove 70 in the outer surface of spool 58 communicates with orifices 66 and 68.

A suitable flow control spring 72 is provided in chamber 62 for biasing spool 58. An annular groove 74 in the outer surface of spool 58 is in fluid communication with chamber 56 at all times. A suitable bore 76 extends through spool 58 so as to communicate groove 74 with chamber 62.

Figures 4, 5, 6, 7, 8, 9:
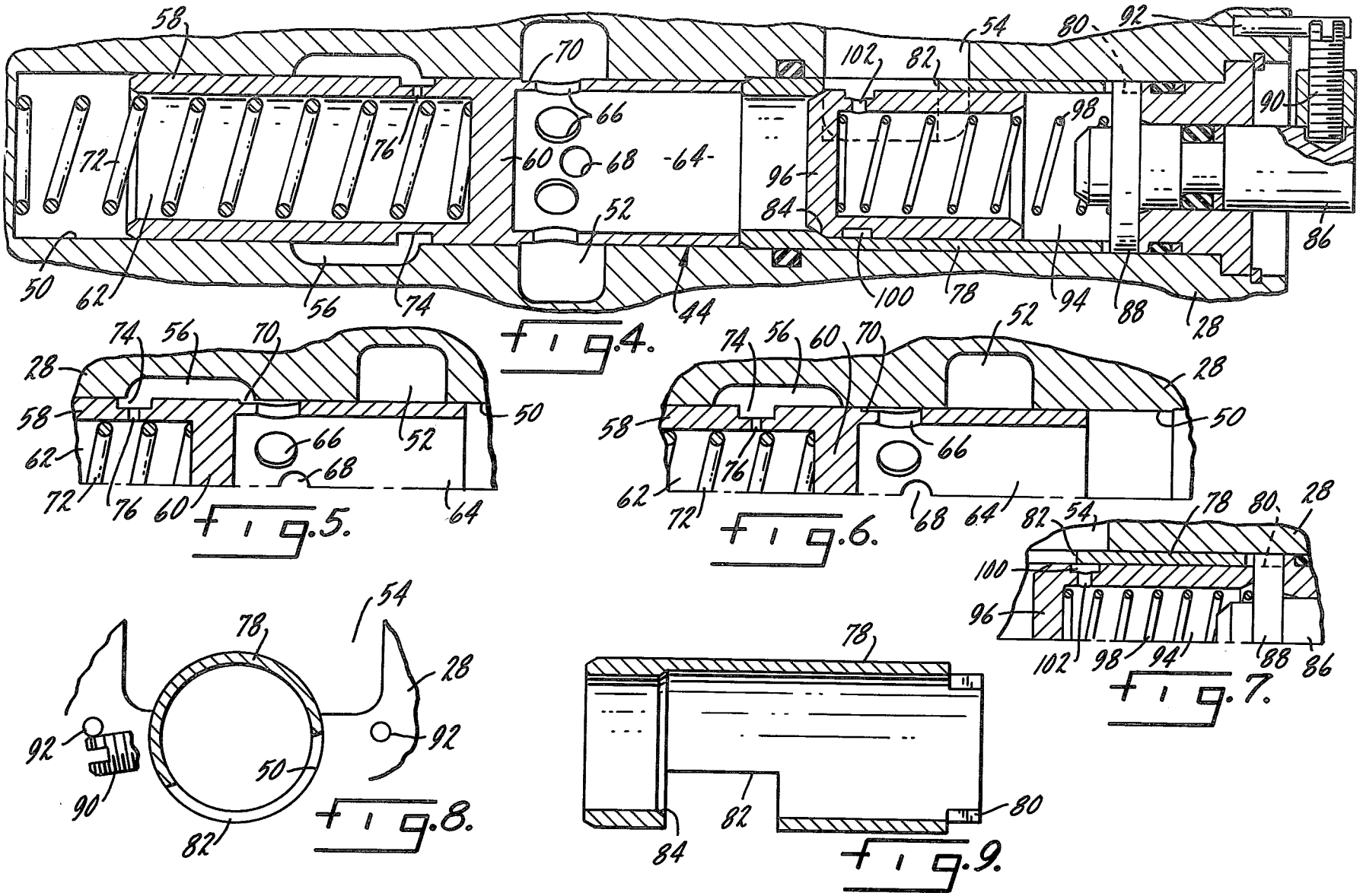
FIG. 4 is an enlarged sectional view showing details of the flow control mechanism of FIGS. 1 and 3 in one position thereof.
FIG. 5 is a partial sectional view, similar to FIG. 4, showing details of the flow control mechanism in another position thereof.
FIG. 6 is a partial sectional view, similar to FIG. 4, showing details of the flow control mechanism in still another position thereof.
FIG. 7 is a partial sectional view, similar to FIG. 4, showing details of the load check valve in another position thereof.
FIG. 8 is an end view, simplified and partially cut away to show details of the throttle in its closed position.
FIG. 9 is a separate sectional view of the throttle valve of the FIG. 4, showing details thereof.

A throttle 78 is rotatably received in bore 50. Throttle 78 defines a notch 80 at one end thereof, a window or opening 82 moveable into and out of fluid communication with chamber 54 as throttle 78 is rotated, and a valve seat 84. A suitable actuator for throttle 78 includes a stem 86 having attached thereto a pin 88 engaged in slot 80 of throttle 78. As stem 86 is rotated manually, throttle 78 rotates in bore 50. As best shown in FIGS. 4 and 8, a set screw 90 or the like extending from stem 86 limits the extent of rotation of throttle 78 by abutting suitable stop pins 92 or the like extending from housing 28. Thus the extent of rotation of throttle 78 is from the fully open position shown in FIG. 4 wherein window 82 is in full communication with chamber 54, to the fully closed position shown in FIG. 8 wherein window 82 is blocked from fluid communication with chamber 54 except for normal leakage.

Throttle 78 defines an interior chamber 94 in which a load check valve 96 is slidably received. A suitable spring 98 is provided in chamber 94 for biasing valve 96 toward valve seat 84. An annular groove 100 in the outer surface of valve 96 is in fluid communication with chamber 54 at all times. A suitable bore 102 extending through valve 96 communicates groove 100 with chamber 94.

A fluid line 104 communicates chamber 56 of flow control mechanism 44 with chamber 40 of bypass valve 24. A fluid line 106 is in communication with chamber 54 of flow control mechanism 44.

In the invention as shown herein, manual control valve 46 is in the form of a valve spool 108 slideable in a bore defined by housing 28. Valve spool 108 is slideable between the neutral position shown in FIG. 1 and two fully-biased power or detented positions. As valve spool 108 slides, the area of meter land opening 110 is varied in a conventional manner. A suitable hydraulically actuated detent kickout mechanism 112 is provided for returning valve spool 108 from either power position to its neutral position at a predetermined pressure level. If it is desired to provide manual control valve 46 with a float capability, a float position for valve spool 108 may be provided in the manner disclosed in the aforementioned U.S. Pat. No. 4,145,958.

Housing 28 defines an inlet port 114 communicating with fluid line 106, an outlet port 116 communicating with tank 18 and first and second motor ports 118 and 120 communicating respectively through fluid lines 122 and 124 with fluid motor 16. Valve spool 108 defines fluid connections 126 and 128. Primary shuttle valve 48 includes side shuttle connections 130 and 132 communicating respectively with fluid connections 126 and 128. Primary shuttle valve 48 also includes center shuttle connection 134 communicating with fluid line 104.

In the neutral position as shown schematically in FIG. 1, there is no fluid communication across metering land 110. Inlet port 114 and motor ports 118 and 120 are blocked. Fluid communication is established from side shuttle connections 130 and 132 respectively across fluid connections 126 and 128 to outlet port 116 and tank 18. In the left power position, inlet port 114 communicates across metering land 110 with motor port 118 and through fluid connection 126 with side shuttle connection 130. Motor port 120 communicates with outlet port 116. Side shuttle connection 132 also communicates through fluid connection 128 with outlet port 116.

In the right power position, inlet port 114 communicates across metering land 110 with motor port 120 and through fluid connection 128 with side shuttle connection 132. Motor port 118 communicates with outlet port 116. Similarly, side shuttle connection 130 communicates through fluid connection 126 with outlet port 116.

With manual control valve 46 in the neutral position, spring chamber 40 and pressure chamber 56 are vented to tank 18 through shuttle valve 48 and manual control valve 46. Supply pressure acts on bypass valve element 34 in opposition to the biasing force of spring 36, and fluid is bypassed from chamber 38 to chamber 42 and tank 18 at a relatively low pressure. For example, if the biasing force of spring 36 is equivalent to 100 psi, the supply neutral or bypass pressure in line 22 will be limited to 100 psi. This 100 psi is sensed in chamber 64. Assuming, for example, that the biasing force of spring 98 is equivalent to 3 psi, check valve 96 will be moved rightwardly from the seated position shown in FIGS. 1 and 4 to the unseated position shown in FIG. 7. Chambers 54 and 94, as well as fluid line 106, are pressurized to 100 psi, and then spring 98 will bias check valve 96 toward its seated position on valve seat 84 once again.

Assuming further that the biasing force of spring 72 is equivalent to 50 psi, spool 58 will be moved leftwardly from the position shown in FIGS. 1 and 4 to the position shown in FIG. 5. Orifices 66 and 68 are closed off, thereby isolating chamber 64 from chamber 52. Then groove 70 is opened to chamber 56, thereby communicating chamber 64 with chamber 56 and tank 18. The 100 psi in chamber 64 bleeds down. When it reaches 50 psi, spring 72 biases spool 58 rightwardly from the position shown in FIG. 5 to the balanced position shown in FIG. 6 wherein chamber 64 is isolated from both chambers 52 and 56. In this position 50 psi is trapped in chamber 64.

Figure 10:
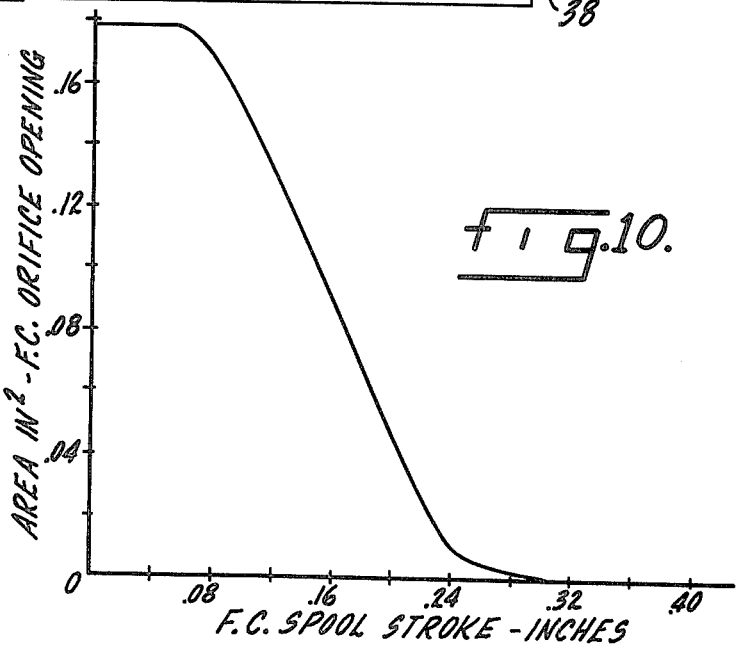
FIG. 10 is a graph illustrating flow characteristics of the flow control mechanism of FIG. 4.

As noted, when flow control spool 58 begins to move leftwardly from the position shown in FIGS. 1 and 4, the areas of orifices of 66 and 68 are occluded. Placement of a relatively small orifice 68 slightly out of alignment from the remaining orifices 66 results in the flow characteristics illustrated in FIG. 10 wherein very fine metering allows smooth operation of flow control mechanism 44 as spool 58 approaches the end of its stroke. Severe oscillation of spool 58 is prevented, and at most a slight dithering thereof provides better stability and more precise metering of fluid than otherwise would be available. Furthermore, the short stroke of spool 58 improves the stress cycle of spring 72.

When manual control valve 46 is shifted to one of the power positions, for example to the right power position, load pressure at motor port 120 becomes a signal pressure, and is sensed in chamber 40 of bypass valve 24 through fluid connection 128, shuttle valve 48 and fluid line 104. Element 34 is biased toward seat 32, thereby further restricting communication between chambers 38 and 42. Supply pressure correspondingly increases.

At the same time, load pressure at motor port 120 also is sensed in chamber 62 of flow control mechanism 44 through fluid connection 128, shuttle valve 48, fluid line 104, chamber 56 and bore 76. Spool 58 is moved rightwardly from the position shown in FIG. 6 to the position shown in FIGS. 1 and 4. Communication is established between chambers 52 and 64 through orifices 66 and 68. Supply pressure and flow now pass across check valve 96, through throttle window 82, to chamber 54. Flow is delivered to fluid motor 16 through fluid line 106, inlet port 114, across metering land 110, and through motor port 120 and fluid line 124.

When the total pressure drop from chamber 64 to chamber 62 reaches 50 psi, spool 58 will begin leftward movement from the position shown in FIGS. 1 and 4. As orifices 66 and 68 begin to close off communication between chambers 52 and 64, the pressure drop therebetween begins increasing. When this pressure drop reaches 50 psi, and the pressure drop from chamber 64 to chamber 40 reaches 50 psi, bypass valve element 34 begins to open. This condition develops the maximum flow obtainable from flow control mechanism 44, with excess flow being bypassed to tank 18.

By controlling the 50 psi pressure drop from chamber 64 to chamber 62, precise regulation of the flow rate to motor port 120 is obtained. The conventional way of controlling this pressure drop is to vary the area of metering land 110 by moving manual control valve spool 108. Increasing or decreasing this area correspondingly increases or decreases fluid flow to motor port 120.

Flow control mechanism 44 provides another way to regulate the rate of flow to motor port 120. This is accomplished by moving manual control valve 46 to the full power or detented position so as to provide the maximum flow area across metering land 110. The flow rate is regulated by flow control mechanism 44 between a minimum flow of something less than 1 gpm, for example, and maximum design flow. Rotation of stem 86 causes rotation of throttle 78. As throttle 78 rotates, throttle opening 82 changes the flow area between bore 50 and chamber 54. As shown in FIG. 8, it is possible to close off this flow area completely. As the area opening is decreased, the pressure drop from chamber 64 to chamber 54 increases. With flow control spool 58 operating at a 50 psi pressure drop, the difference between 50 psi and the pressure drop from chamber 64 to chamber 54 is sensed at the area opening of metering land 110. Therefore, increasing the pressure drop across throttle opening 82 will decrease the pressure drop across metering land 110. Similarly, decreasing the pressure drop across throttle opening 82 will increase the pressure drop across metering land 110. For a constant area opening at metering land 110, a precise and accurate regulated rate of flow to motor port 120 is provided by controlling the pressure drop across throttle opening 82, i.e., the pressure drop from chamber 64 to chamber 54.

Figure 2:
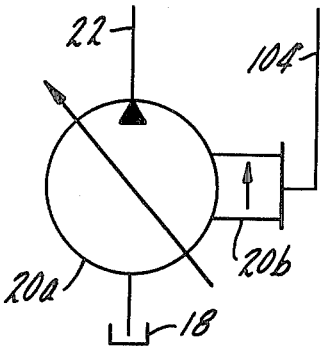
FIG. 2 is a schematic diagram showing how the assembly of FIG. 1 may be of the type having a closed-center valve and a variable displacement pump.

The invention herein is readily adaptable for use with a fluid control system incorporating a manual control valve of the closed-center type. As shown in FIG. 2, supply section 10 and inlet section 12 would be replaced by a variable displacement pump 20*a* communicating with fluid line 22, and a compensator 20*b* communicating with fluid line 104.

Thus it will be seen that a fluid control system is provided, which system incorporates a manual control valve capable of functioning in either an open-center or closed-center type hydraulic circuit, with the manual control valve having a neutral position, two power positions and, if desired, a float position. An individually variable flow control mechanism is associated with the manual control valve. The flow control mechanism is responsive independently to load pressure, and is capable of controlling the rate of flow delivered to the load by varying the flow to the manual control valve while the manual control valve spool is in a full power position. Alternatively, the rate of flow delivered to the load may be controlled by the conventional method of varying the area opening of the metering land in the control valve spool itself. A pressure responsive, hydraulically actuated kick-out mechanism is provided for returning the control valve spool from either power position to its neutral position at a predetermined pressure level.

Figure 3:
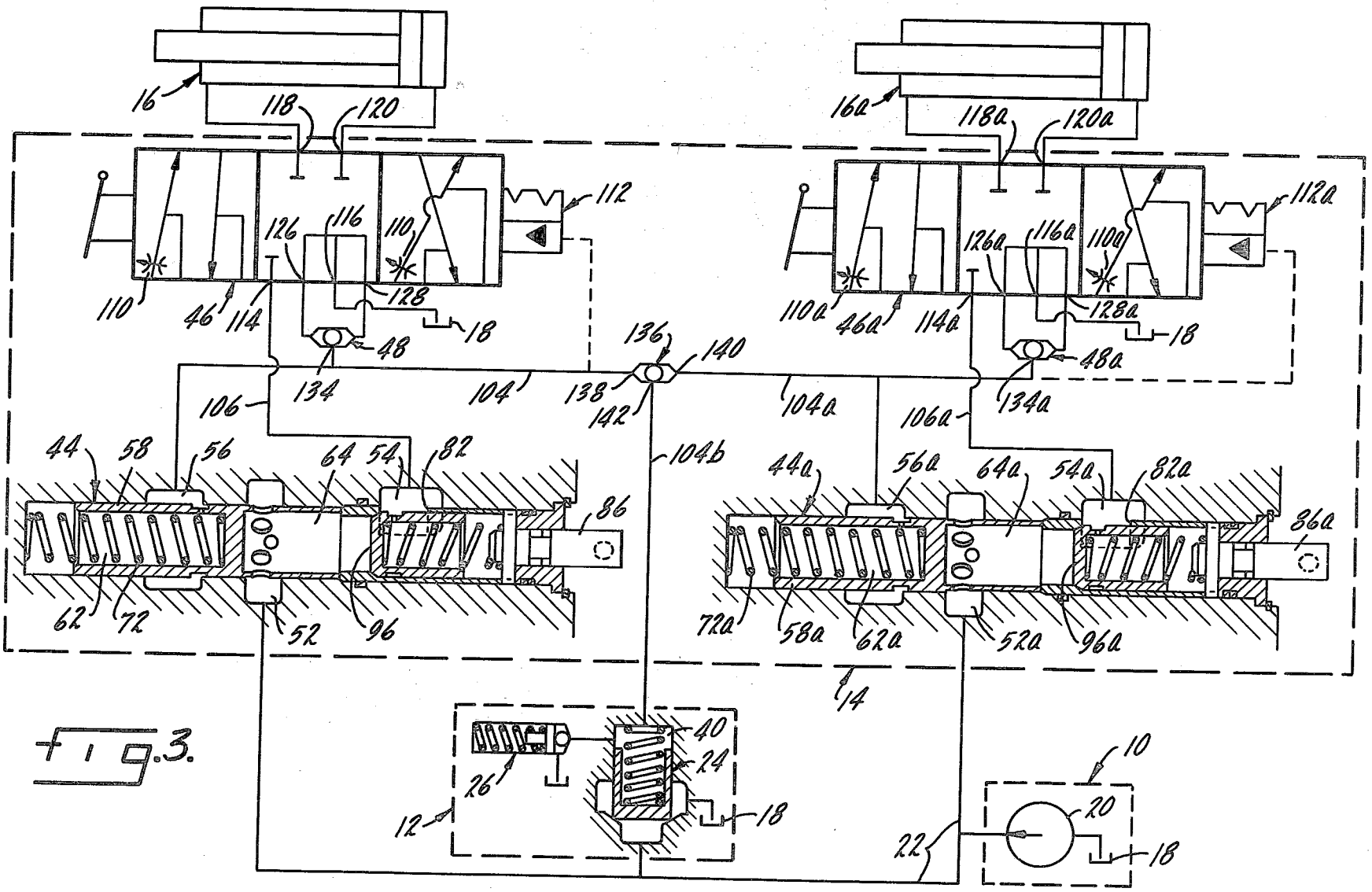
FIG. 3 is a schematic diagram, similar to FIG. 1, showing the directional control valve assembly having a plurality of control sections.

There may be circumstances in which it is desirable to incorporate a plurality of valve sections in directional control valve assembly 14. This is shown schematically in FIG. 3, where one or more additional valve sections are represented by flow control mechanism or valve 44*a*, manual control valve 46*a*, and a logic circuit including as a portion thereof a primary shuttle valve 48*a*. In a preferred form of the invention as shown herein, all of the valve sections are identical. A suitable fluid motor 16*a* may be identical or similar to fluid motor 16.

A secondary shuttle valve 136, corresponding to shuttle valve 130 in the aforementioned U.S. Pat. No. 3,693,506, has side shuttle connections 138 and 140 and a center shuttle connection 142. Shuttle valve 136 is inserted in fluid line 104 with shuttle connection 138 communicating with shuttle connection 134 of primary shuttle valve 48, with shuttle connection 140 communicating through a fluid line 104*a* with shuttle connection 134*a* of primary shuttle valve 48*a*, and with shuttle connection 142 communicating through a fluid line 104*b* with chamber 40 of bypass valve 24.

In the neutral and power positions the system operates in the manner described above. When operating more than one section simultaneously, the highest load pressure will be sensed through shuttle valve 136 in chamber 40 of bypass valve 24. The flow control mechanism associated with any section operating at a lower pressure will function independently of supply pressure. For example, if 2500 psi were sensed in chamber 52*a* due to the operation of manual control valve 46*a*, with manual control valve 46 operating such that 1000 psi were sensed in chamber 64, then flow control spool 58 would move leftwardly to partially occlude orifices 66 and 68. This movement would continue until a pressure drop of 1500 psi (2500 psi–1000 psi) across orifices 66 and 68 delivered whatever flow would result in a 50 psi drop from chamber 64 to chamber 62. This 50 psi pressure drop may be taken across metering land 110 when throttle 78 is in the wide open position; or it may be taken in any proportion across throttle opening 82 and metering land 110 by adjustment of throttle 78.

When, for example, manual control valve 46 is in neutral and manual control valve 46*a* is in a power position, flow control mechanism 44 precludes the possibility of leakage across manual control valve 46 which might be sufficient to actuate fluid motor 16. This dangerous condition would be precluded because the pressure drop from chamber 64 to chamber 62 could never be more than, for example, 50 psi.

Leakage from chamber 54 to chamber 94 is tolerable, and indeed reduces the criticality of tolerances for throttle 78. It is only necessary to provide a fit close enough to prevent check valve 96 from cocking.

Check valve 96 functions to prevent dropping of a load when manual control valve 46 is in a full or partial power position and a low pressure is sensed in chamber 52. For example, if manual flow control valve 46*a* is biased to deliver full pump flow at 1000 psi to fluid motor 16*a* while manual control valve 46 is biased with a 2000 psi suspended load, 2000 psi would be sensed in chamber 40 of bypass valve 24. However, supply pressure would not increase because full pump flow is being delivered through manual control valve 46*a*. In this condition, 1000 psi is sensed in chamber 64, and 2000 psi is sensed in chambers 54 and 94. Check valve 96 is seated securely on valve seat 84, thus preventing the suspended load from dropping.

Although check valve 96 is shown as being contained within throttle 78, it should be understood that it may be located in any convenient position between chamber 64 and inlet port 114.

In the event a negative load condition is experienced at either power position, flow control spring 72 or 72*a* will move its associated flow control spool 58 or 58*a* rightwardly to the position shown in FIG. 4. This allows full pump flow to be delivered to the section experiencing such a negative load. If this condition should occur while more than one manual control valve is being operated, the load check valve associated with the section operating at the highest pressure will seat, thereby allowing full pump flow to be delivered to the cavitated section.

While a preferred embodiment of the invention has been shown and described, this should be considered as illustrative and may be modified by those skilled in the art. It is intended that the claims herein cover all such modifications as may fall within the spirit and the scope of the invention.

What is claimed is:

1. In a fluid system including fluid supply means, a fluid motor, and directional control valve means movable between a neutral position and a power position for controlling fluid flow from said fluid supply means to said fluid motor; the improvement comprising flow control means responsive to load pressure at said fluid motor for maintaining a constant rate of fluid flow from said fluid supply means to said fluid motor when said directional control valve means is in said power position, said flow control means being independently variable to determine said constant rate.

2. The invention of claim 1, said directional control valve means being movable to vary the flow area thereacross, thereby effecting said control of said fluid flow from said fluid supply means to said fluid motor, and said flow control means being independently variable to vary the pressure drop across said directional control valve means when said directional control valve means is in said power position, thereby effecting said determination of said constant rate of fluid flow from said fluid supply means to said fluid motor when said directional control valve means is in said power position.

3. The invention of claim 2, said flow control means being independently variable to increase and decrease the pressure drop across said directional control valve means, thereby correspondingly increasing and decreasing said constant rate.

4. The invention of claim 3, said flow control means being independently variable to decrease and increase the pressure drop thereacross, thereby correspondingly increasing and decreasing said pressure drop across said directional control valve means.

5. A flow control mechanism comprising a housing defining a bore; inlet, outlet, and pressure chambers communicating with said bore; a flow control element movable in said bore; said flow control element at least partially defining a first chamber communicating with said bore and a second chamber communicating with said pressure chamber; said flow control element being movable to a first position communicating said inlet and first chambers, to a second position isolating said first chamber from said inlet chamber and communicating said first and pressure chambers, and to a third position isolating said first chamber from said inlet and pressure chambers; means biasing said flow control element toward said first position; and throttle means movable for varying said communication of said outlet chamber with said bore.

6. The invention of claim 5, said flow control element being slidable in said bore.

7. The invention of claim 5, said throttle defining a window adapted to communicate said outlet chamber with said bore, said throttle means being movable for varying the size of said window, thereby varying said communication of said outlet chamber with said bore.

8. The invention of claim 7, said flow control element being slidable in said bore, and said throttle means being rotatable in said bore.

9. The invention of claim 5, further comprising means for preventing substantial fluid flow in a direction from said outlet chamber to said first chamber.

10. The invention of claim 8, said throttle defining a valve seat between said first chamber and said window, a check valve slidable relative to said throttle, and means biasing said check valve toward said valve seat.

11. The invention of claim 10, said throttle defining an interior chamber, said check valve being slidable in said interior chamber, and said check valve defining means communicating said outlet and interior chambers.

12. A fluid system comprising fluid supply means, signal responsive means for controlling fluid supply pressure, a fluid motor, and a directional control valve assembly including a directional control valve having an inlet port, an outlet port, first and second motor ports communicating with said fluid motor, and first and second control ports, said directional control valve being movable between a neutral position communicating said first and second control ports with said outlet port, a first power position communicating said inlet port with said first motor and control ports and communicating said second motor and control ports with said outlet port, and a second power position communicating said inlet port with said second motor and control ports and communicating said first motor and control ports with said outlet port, means communicating with said control ports for selecting the higher pressure sensed at said motor ports for use as a signal, and the flow control mechanism of claim 5, said fluid supply means communicating with said inlet chamber, said outlet chamber communicating with said inlet port, and said pressure chamber and supply pressure controlling means communicating with said selecting means so as to sense said signal.

13. The invention of claim 12, said fluid supply means including a fixed displacement pump, and said supply pressure controlling means including bypass valve means constructed and arranged such that increasing and decreasing pressure at one of said motor ports tends to bias said bypass valve means so as to correspondingly increase and decrease said supply pressure.

14. The invention of claim 12, said fluid supply means including a variable displacement pump, and said pressure controlling means including a pump compensator.

15. In a fluid system including fluid supply means, a plurality of fluid motors, and a directional control valve assembly having a plurality of flow control sections, each section including a directional control valve movable between a neutral position and a power position for controlling fluid flow from said fluid supply means to an associated fluid motor; the improvement wherein each section comprises flow control means responsive to load pressure at its associated fluid motor for maintaining a constant rate of fluid flow from said fluid supply means to its associated fluid motor when said directional control valve is in said power position, said flow control means being independently variable to determine said constant rate.

16. A fluid system comprising fluid supply means; signal pressure responsive means for controlling fluid supply pressure; a plurality of fluid motors; and a directional control valve assembly having a plurality of flow control sections; each section including a directional control valve having an inlet port, an outlet port, first and second motor ports communicating with an associated fluid motor, and first and second control ports, said directional control valve being movable between a neutral position communicating said first and second control ports with said outlet port, a first power position communicating said inlet port with said first motor and control ports and communicating said second motor and control ports with said outlet port, and a second power position communicating said inlet port with said second motor and control ports and communicating said first motor and control ports with said outlet port, primary means communicating with said first and second control ports for selecting the higher pressure sensed at said first and second motor ports for use as a signal pressure, and the flow control mechanism of claim 5, said outlet chamber communicating with said inlet port, and said pressure chamber communicating with said primary means so as to sense said signal pressure; said fluid supply means communicating with said inlet chambers; and secondary means communicating with said primary means for selecting the highest signal pressure, said supply pressure controlling means communicating with said secondary means so as to sense said highest signal pressure.

17. The invention of claim 16, said fluid supply means including a fixed displacement pump, and said pressure controlling means including bypass valve means constructed and arranged such that increasing and decreasing highest signal pressure tends to bias said bypass valve means so as to correspondingly increase and decrease said supply pressure.

18. The invention of claim 16, said fluid supply means including a variable displacement pump, and said pressure controlling means including a pump compensator.

19. The invention of claim 15, each of said flow control means being independently variable to vary the pressure drop across its associated directional control valve when said directional control valve is in its power position, thereby effecting said determination of said constant rate.

20. The invention of claim 19, each of said flow control means being independently variable to increase and decrease the pressure drop across its associated directional control valve, thereby correspondingly increasing and decreasing said constant rate.

21. The invention of claim 20, each of said flow control means being independently variable to decrease and increase the pressure drop thereacross, thereby correspondingly increasing and decreasing said pressure drop across its associated directional control valve.

* * * * *